US005257478A

United States Patent [19]

Hyde et al.

[11] Patent Number: 5,257,478

[45] Date of Patent: Nov. 2, 1993

[54] APPARATUS FOR INTERLAYER PLANARIZATION OF SEMICONDUCTOR MATERIAL

[75] Inventors: Thomas C. Hyde, Chandler, Ariz.; John V. H. Roberts, Newark, Del.

[73] Assignees: Rodel, Inc., Newark, Del. ; a part interest; Westech Systems, Inc., Phoenix, Ariz.

[21] Appl. No.: 829,736

[22] Filed: Jan. 31, 1992

Related U.S. Application Data

[63] Continuation of Ser. No. 497,551, Mar. 22, 1990, abandoned.

[51] Int. Cl.[5] ..... B24B 7/22; B24B 1/00

[52] U.S. Cl. ..... 51/131.3; 51/401; 51/297; 51/283 R

[58] Field of Search ..... 51/109 R, 125, 129, 51/131.1, 131.3, 131.4, 131.5, 394, 401, 397, 407, 293, 296, 297, 283 R

[56] References Cited

U.S. PATENT DOCUMENTS

| | | | |
|---|---|---|---|
| 3,499,250 | 3/1970 | Jensen et al. | 51/401 |
| 3,504,457 | 4/1970 | Jacobsen et al. | 51/131.4 |
| 4,512,113 | 4/1985 | Budinger | 51/131.5 |
| 4,879,258 | 11/1989 | Fisher | 51/131.1 |

*Primary Examiner*—Bruce M. Kisliuk
*Assistant Examiner*—Bryan Reichenbach
*Attorney, Agent, or Firm*—Tod R. Nissle

[57] ABSTRACT

A pad for planarizing the surface of a semiconductor wafer. The pad includes at least two layers. One layer has a hydrostatic modulus which is different from the hydrostatic modulus of the other pad.

9 Claims, 4 Drawing Sheets

FIG. 1
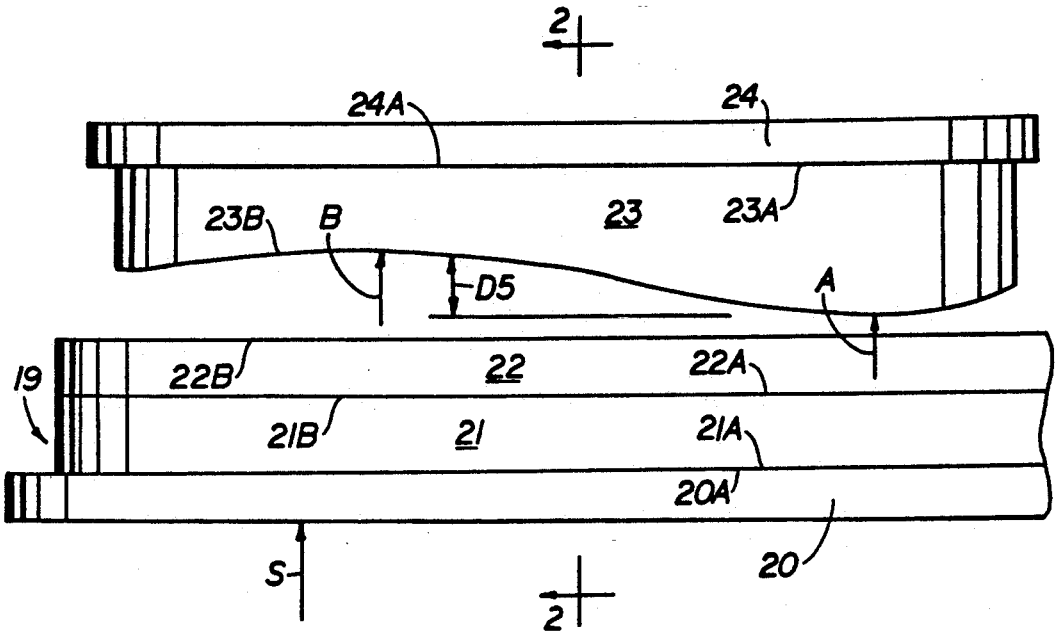
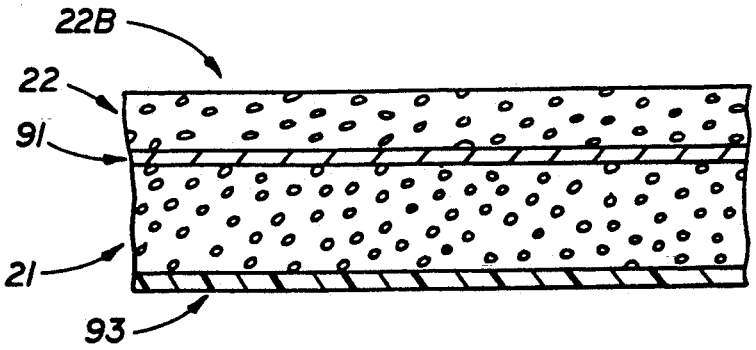
FIG. 8

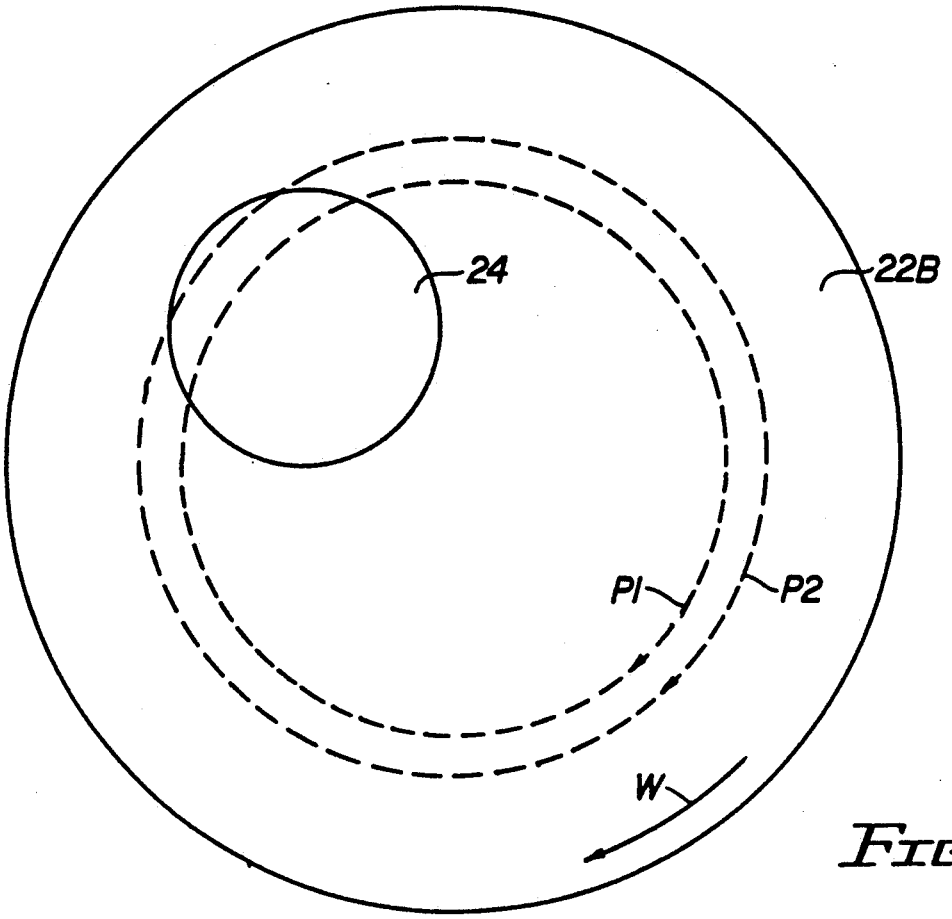
FIG. 6
FIG. 7
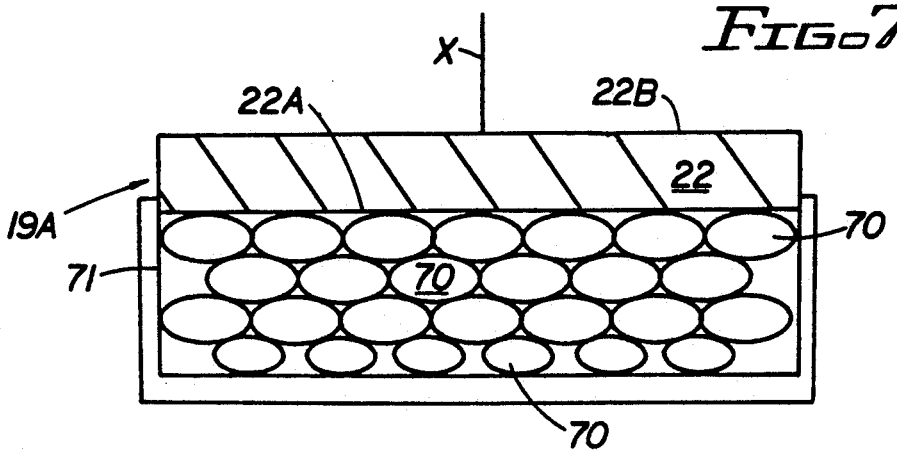

APPARATUS FOR INTERLAYER PLANARIZATION OF SEMICONDUCTOR MATERIAL

This application is a continuation of application Ser. No. 07/497,551, filed Mar. 22, 1990, now abandoned.

This invention relates to planarizing apparatus.

More particularly, the invention relates to apparatus for planarizing the macroscopically flat surface of a semiconductor wafer to expose microscopic features which have been formed in the semiconductor wafer and are below and covered by the macroscopically flat surface of the wafer.

In a further respect, the invention relates to semiconductor planarizing apparatus of the type described which facilitates the removal at equal rates of areas of hard material and of soft material from the surface of a semiconductor wafer.

Composite pads for polishing semiconductor materials are well known in the art. See, for example, U.S. Pat. No. 3,504,457 to Jacobsen et al. The Jacobsen patent discloses a composite or multi-layer pad which includes a resilient foam polyurethane polishing layer or film 23, an intermediate resilient Corfam layer 20, and a chemically inert stiffer nitrile rubber layer 35. In the Jacobsen composite polishing pad, the more resilient layers of the pad are adjacent the semiconductor while the stiffer nitrile rubber layer is further from the semiconductor which is being polished. While the resilient pads like the Jacobsen pad have long been utilized and accepted in polishing semiconductor materials, such conventional resilient pad structures do not appear to readily uniformly planarize a macroscopically or microscopically flat semiconductor surface which includes areas which are higher (or lower) than other areas of the semiconductor substrate or which includes areas which are softer than and abrade and flatten more quickly than other harder areas of the semiconductor surface. In particular, conventional pads tend to sit on and round the edges of a high area so the high area takes on the shape of a rounded mound. The planarization and flattening of the surface of a semiconductor material is particularly critical during the process of photolithography. During a typical photolithography process a metal film of aluminum, tungsten, polysilicon, etc. is deposited on a flat semiconductor wafer. A layer of photoresist is sprayed on or otherwise applied to the metal film. The photoresist is photoactive. A mask is placed over the photoresist layer and the layer and mask are exposed to light. The areas of photoresist which are not covered by the mask are exposed to the light and harden. The mask is removed. A chemical is utilized to remove the unexposed, unhardened areas of the photoresist. Another chemical is utilized to etch off the unprotected metal which is exposed when the unexposed photoresist is etched off. Still another chemical is then utilized to remove the hardened photoresist from the lines or strips of metal film which remain on the flat semiconductor wafer. After the hardened photoresist is removed, the metal lines or strips which remain on the flat semiconductor wafer typically have a width in the range of about 0.3 to 2.0 microns, preferably, in the range of 0.5 to 1.0 microns. The thickness or height of the metallic lines is also in the range of 0.3 to 2.0 microns, preferably 0.5 to 1.5 microns. A coating of silicon dioxide or other metal oxide or other insulating material is then deposited over the metal lines and remaining open areas of the flat semiconductor material. The depth or thickness of the metallic oxide coating is greater than the height of the metal lines, i.e., is greater than the 0.3 to 2.0 micron height of the metal lines. This metallic oxide is polished until the tops of the metal lines are "exposed". Such "exposing" of the metal lines consists of polishing away all the metal oxide on top of the metal lines or of polishing away most of the metal oxide so only a thin layer of metal oxide remains on the metal lines. The metal lines can have a hardness greater than that of the insulating coating which is intermediate the metal lines, in which case the insulating coating tends to be "scoured" out between the metal lines such that a flat planar surface is not formed during the interlayer dielectric planarization of the metal lines—insulator material. Alternately, the metal lines can have a hardness less than that of the insulating coating which is intermediate the metal lines, in which case the metal lines tend to be "scoured" out when the polishing process is continued after all of the insulating coating is removed from above the metal lines.

While a metal or metal-like material may be deposited on a semiconductor wafer, the primary objective in removing a material deposited on a semiconductor wafer is to planarize or flatten the surface of the wafer and is not making the surface of the wafer smoother. In contrast, the primary purpose of polishing a metal is typically to make the surface of the metal smooth. The distinction between polishing for the purpose of smoothness and removing material for the purpose of flatness is an important one and affects the characteristics of the planarizing apparatus selected. Polishing apparatus which is effective in producing a smooth surface may not be successful in producing the close tolerance flat or planar surfaces required in the production of semiconductor materials.

Accordingly, it would be highly desirable to provide an improved apparatus and method for planarizing semiconductor materials, which apparatus and method would accurately planarize a semiconductor surface comprised of materials which have differing polishing characteristics.

Therefore, it is a principal object of the invention to provide an improved apparatus and method for planarizing a material to produce a flat surface on the material.

A further object of the invention is to provide an improved planarization method and apparatus which effectively flattens within close tolerances the surface of a semiconductor material containing compositions of differing hardness.

Another object of the instant invention is to provide an improved composite planarization pad which includes layers of material having differing hydrostatic moduli.

Still a further object of the invention is to provide an improved planarization pad which minimizes the effect of hysteresis on the elastic compression and expansion of the pad.

These and other, further and more specific objects and advantages of the invention will be apparent to those skilled in the art from the following detailed description thereof, taken in conjunction with the drawings, in which:

FIG. 1 is a side view illustrating a semiconductor material with an undulating microscopically flat surface and a portion of a composite polishing pad utilized to planarize the surface of the semiconductor material;

FIG. 6 is a top view of the pad and wafer carrier of FIGS. 1 and 4;

FIG. 7 is a section view illustrating an alternate planarizing pad of the invention; and, FIG. 8 is a section view illustrating a planarization pad with three active layers.

Figure 2:
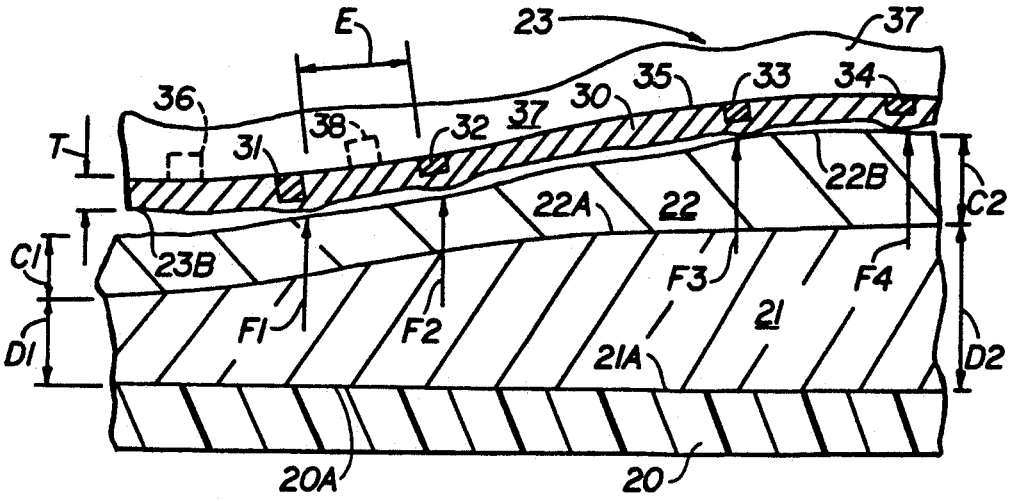
FIG. 2 is a side section view of portions of the polishing pad and semiconductor material of FIG. 1 further illustrating construction details thereof.

Briefly, in accordance with our invention, we provide improved apparatus for planarizing a piece of material. The piece of material includes a macroscopically flat subsurface; at least a pair of features each connected to the subsurface, each extending a substantially equal distance above the subsurface, and being spaced apart a distance of less than five hundred microns; and, a coat extending over and covering the features and the subsurface. The surface of the coating comprises a work surface which is macroscopically flat. The improved planarizing apparatus microscopically flattens the work surface to expose the pair of features and includes polishing pad means. The polishing pad means includes a base; a first layer of resilient material connected to the base and having an outer surface spaced apart from the base and having a hydrostatic modulus which is less than about 250 to 400 psi when a pressure in excess of about four psi is applied to the first layer of material; a second layer of resilient material connected to at least a portion of the outer surface, having a planarizing surface spaced apart from the outer surface, and including a slurry polishing media on the planarizing surface of the second layer. The improved planarizing apparatus also includes retaining means for holding the piece of material with the work surface disposed against the planarizing surface; and, motive power means for moving at least one of the pad means and the retaining means with respect to the other such that movement of the one of the pad means and the retaining means causes the slurry media and planarizing surface to contact and planarize the work surface.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a cylindrical piece of wafer or semiconductor material 23 or other material mounted on a cylindrical polishing head 24. Head 24 has a circular support surface 24A which receives the macroscopically flat circular planar bottom surface 23A of wafer 23. As used herein, the term "macroscopically flat" indicates that a surface appears flat to the human eye. The term "microscopically flat" indicates that a surface has a small undulation which ordinarily equals a 0.1 to 4.0 micron deviation from a median plane passing through the surface. For example, the distance D5 for the microscopically flat subsurface 23B in FIG. 1 is typically on the order of about two to three microns. As used herein, the term "microscopically flat" indicates a surface that has a deviation of 4.0 microns or less from a median plane passing through the surface. A macroscopically flat surface may or may not be microscopically flat.

Figure 3:
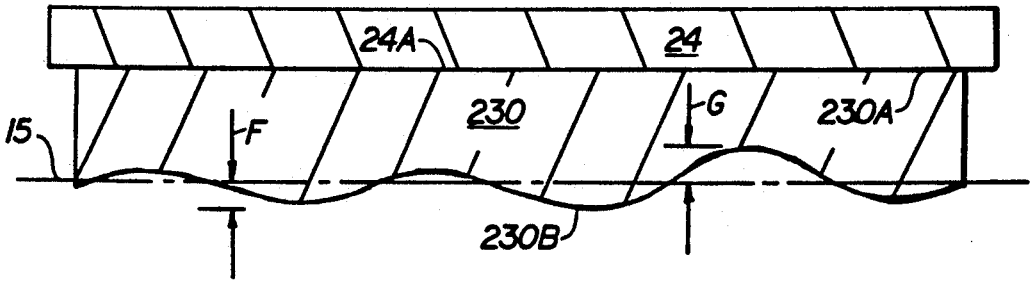
FIG. 3 is a side section view of a semiconductor material illustrating the median plane through the macroscopically or microscopically flat surface of the semiconductor material.

The deviation of the work surface of a semiconductor wafer from the median plane of the wafer is further explained with reference to FIG. 3. In FIG. 3 semiconductor wafer 230 is mounted on cylindrical head 24. The circular planar support surface 24A of head 24 receives the macroscopically flat circular planar bottom surface 230A of wafer 230. The upper work surface 230B is macroscopically and microscopically flat and generally parallel to surface 24A. The undulation of surface 230B in FIG. 3 (and of surface 23B in FIG. 1) is drawn greatly exaggerated. Dashed line 15 in FIG. 3 represents the median plane for surface 120B. Median plane 15 in FIG. 3 is, but need not be, generally parallel to surface 24A and is perpendicular to the plane of the sheet of paper of the drawings. Median plane 15 intersects surface 230B such that the sum of all distances to points underneath median plane 15 and of all distances to points above median plane 15 is zero. The distance to points beneath plane 15 are treated as negative values while the distances to point above the median plane 15 are treated as positive values. Therefore, in FIG. 3 the distance indicated by arrows G is a negative value while the distance indicated by the arrows F is a positive value. In actual practice, distances such as those indicated by arrows F and G in FIG. 3 are in the range of about 0.1 to 4.0 microns. Median plane 15 is perfectly flat.

Returning to FIG. 1, pad means 19 includes a cylindrical metal base 20 with a circular planar upper surface 20A. The macroscopically flat planar bottom surface 21A of resilient pad 21 is attached to surface 20A, typically with a layer of adhesive. Upper macroscopically planar surface 21B is attached to the lower macroscopically planar surface 22A of flexible pad 22. Adhesive is ordinarily utilized to interconnect surfaces 21B and 22A, although FIG. 8 will show a further improvement. The upper surface 22B of resilient pad 22 is generally macroscopically planar and can be microscopically planar. Surfaces 20A, 21A, 21B, 22A, and 22B can be of any desired shape and dimension.

FIG. 2 is a section view of the pad means 19 and semiconductor wafer 23 of FIG. 1 further detailing construction details thereof. The wafer 23 includes a macroscopically planar subsurface 35. Features 31, 32, 33, 34, 36, and 38 are each connected to subsurface 35 and extend a substantially equal distance away from subsurface 35. Features 31 to 34 each represent a line or strip of metal or some other material formed on subsurface 35 using the photolithography process earlier described. Features 31 to 34 each includes side surfaces which extend outwardly away from subsurface 35 to a relatively planar outer surface comprising the tip of each feature 31 to 34. The side surfaces of each feature 31 to 34 are generally perpendicular to subsurface 35. The outer surface or tip of each feature 31 to 34 is generally parallel to subsurface 35. An alternate method of forming features which are connected to and extend away from subsurface 35 is to form trenches 36 and 38. In FIG. 2 coating layer 30 extends over and covers features 31 to 34, 36, 38 and covers subsurface 35. The high areas of coating 30 which "mound" or extend over features 31 to 34 abrade at a different rate than the low areas of coating 30 intermediate features 32 and 32, 32 and 33, etc. The minimum thickness, represented by arrows T, of coating layer 30 is greater than the distance which each feature 31 to 34 extends away from subsurface 35. Since features 31 and 34 are generally of equal shape and dimension, this means that the work surface 23B is at all points a greater distance from subsurface 35 than are the uppermost planar portions or tips of features 31 to 34. The shape and dimension of each trench 36 and 38 is generally equivalent to the shape and dimension of each feature 31 to 34. It is understood that features 31 to 34, 36, and 38 can be of any desired shape and dimension. The polishing apparatus of the invention is, however, particularly useful when it is necessary to planarize work surface 23B to remove a sufficient thickness of coating 30 to expose only the flat, planar tips or other outermost parts of features 31 to 34. In so removing a portion of coating 30, it is desired that the resulting surface of coating 30 be flat, i.e., be planarized. It is also desired that the side surfaces of features 31 to 34 not be exposed but remain covered by layer 30. Accordingly, planarizing surface 22B does not conform to features 31 to 34 by extending over the side surfaces of features 31 to 34. It is, however, important that the surface 22B of the material comprising pad 22 directly contact the work surface 23 or slurry intermediate pad 22 and surface 23. For the purposes of discussion, the undulation in subsurface 35 and work surface 34B is, in FIG. 2, greatly exaggerated.

In FIG. 1, when the resilient pads 22 and 21 are pressed in the direction of arrow S against work surface 23B (or vice-versa), the pads 22 and 21 are compressed. The force generated against point B on surface 23B by pads 22 and 21 will be less than the force generated by compressed pads 22 and 21 against point A on surface 23B, simply because pads 22 and 21 are compressed more by surface 23B at point A than at point B. Similarly, in FIG. 2, the forces F1 and F2 acting against surface 23B are greater than the forces F3 and F4 acting against surface 23B, again because the pad portions producing forces F1 and F2 are more greatly compressed than the pad portions producing forces F3 and F4.

Suitable materials for layers 21 and 22 may be selected from elastic and volume compressible polishing materials made by Rodel, Inc., under the trade names Politex, Suba, MH, and IC. Additionally, layer 21 may utilize conventionally manufactured foam materials such as the neoprene foam used to make diver's wetsuits. All of these materials are easily bonded together by ordinary adhesives commonly known in the art.

In preparing pads of this invention, it was found that the adhesive layer between surfaces 21A and 22B unexpectedly affected the overall performance of the pad for planarizing certain structures. In particular, improvement was noted in planarizing structures containing soft elements that could be easily scratched or damaged during the planarization process. By making the adhesive less resilient or, better, adding an additional non-resilient layer between 21 and 22, the selection of materials for layer 22 could be further optimized to improve performance on such structures. The existence of the non-resilient layer permits the polishing layer 22 to have a greater volume compressibility and less likely to cause damage to fragile features of the work surface, while still yielding good planarization. FIG. 8 illustrates a pad of such construction wherein layer 93 is the adhesive required for bonding the pad to base 20; layer 21 is an elastic material containing at least 30% and preferably 40%-70% of its volume composed of void volume; layer 91 is a thin film of essentially non-resilient, non-compressible material such as polyester, nylon, metal, epoxy, fiberglass reinforced epoxy, or the like which typically has a hardness of at least 90° Shore A; and layer 22 is selected to have at least 25% and preferably more than 35% void volume. In the pad of FIG. 8, layer 22 must have a thickness of at least 5 mils and preferably 10 to 35 mils; layer 91 at least 3 mils and preferably 5 to 15 mils thickness; layer 21 may be almost any thickness greater than 15 mils, a thickness of 30 to 50 mils works well in most applications. In the construction of FIG. 8, both layers 21 and 22 must be volume compressible. If the material simply distorts and is not volume compressible, the dynamic action of the workpiece moving over the pad will produce waves which interfere with the desired planarization. We have found that the compressibility of layer 21 must be at least 5% under a load of 10 psi., and for most applications a compressibility of 10% to 30% will be most suitable. Layer 22 which comes in contact with the workpiece sees very high localized compressive forces. It must have a volume compressibility of at least 5% under a load of 100 psi.

In FIG. 2, surface 22B contacts and rotates over work surface 23B. An aqueous suspension of silica, alumina or other abrasive (the "slurry") is on surface 22B and gradually removes material from and planarizes work surface 23B. The rotation of surface 22B with respect to work surface 23B is illustrated in FIG. 6. In FIG. 6 circular surface 22B rotates in the direction of arrow W. Stationery head 24 presses work surface 23B against planarizing surface 22B. Head 24 can, if desired, rotate or otherwise move with respect to surface 22B.

The objective of planarizing pad means 19 is to produce a surface 23B which is substantially microscopically flat or planar to within plus or minus 200 to 500 Angstroms Total Indicator Runout (T.I.R.) of a square portion of surface area 23B which is four millimeters by four millimeters, i.e., which has an area of sixteen square millimeters. A T.I.R. of 200 to 500 Angstroms means that there is a difference of 200 Angstroms between the lowest point and the highest point on the surface within the sixteen square millimeter area of surface 23B. A T.I.R. in the range of 200 to 500 Angstroms is generally equivalent to a plus or minus deviation of 100 to 250 Angstroms from the median plane of the sixteen square millimeter area. While the apparatus of the invention has produced a T.I.R. of 200 to 500 Angstroms in a sixteen square millimeter area, the apparatus is preferably used to produce a T.I.R. of 200 to 500 Angstroms in a square portion of surface area 23B which has an area of at least four square millimeters. It is desired to eventually achieve with the invention or with improved embodiments thereof a T.I.R. of 200 to 500 Angstroms over a surface area of 23B which is twenty millimeters by twenty millimeters, i.e., which has an area of 400 square millimeters.

Problems are encountered in planarizing coating 30 because features 31 to 34 often have a different hardness or removal properties than the material comprising coating 30. If, for example, coating 30 abrades more readily than features 31 and 32, the area of coating intermediate features 31 and 32 may tend to scour out and form a depressed area intermediate features 31 and 32.

The planarization apparatus of the invention minimizes or prevents the scouring of softer material from the surface of a semiconductor material. For example, when the distance between high features 31 and 34 is 500 to 600 microns or less, features 31 and 32 are metal lines, and coating 30 is an insulative metal oxide or other material which is harder or softer than or is of the same hardness as features 31 and 32, the apparatus of the invention typically produces a planarized surface which extends between the outermost tips of features 31 and 32 and is flat to within 200 to 300 Angstroms.

An important distinction in the understanding of this invention is the distinction between hardness, resilience, stiffness, etc. on one hand and volume compressibility on the other. Although prior art has been concerned with properties of hardness, resilience, etc. in polishing pads, these terms are often used to reflect the material's resistance to bending distortion or ability to recover after such distortion, simply because the prior art is concerned with the conforming of a pad to irregularities in the work surface of a semiconductor and is not focusing on planarization. For example, a piece of solid, soft rubber may be said to be "not hard" or "stiff." These terms describe the ease of changing the shape of a pad (modulous of distortion) even though there is no change in the volume of the pad. In the present invention, layers 21 and 22 must manifest a change in volume, not just shape. "Compressibility" as used in this invention refers to change in volume as indicated by volumetric strain.

In the practice of the invention, the resilient layer 22 has a hydrostatic modulus, K, in the range of 400 to 5000 psi (assuming that the thickness of the layer is small compared to the diameter of the layer 22) per psi of compressive pressure when a compressive pressure in the range of four psi to twenty psi is applied to the layer 22. For example, if a compressive force of four psi is applied to layer 22, then the hydrostatic modulus, K, of layer 22 is in the range of 1600 to 20,000 psi. If a compressive force of twenty psi is applied to layer 22 then the hydrostatic modulus, K, of layer 22 is in the range of 8000 to 100,000 psi. The resilient layer 21 has a hydrostatic modulus of greater than 100 psi per psi of the compressive pressure when a compressive force in the range of four psi to twenty psi is applied to layer 21. The hydrostatic modulus of layer 21 presently preferably is in the range of 100 to 250 psi per psi of compressive force when a compressive force in the range of four psi to twenty psi is applied to the layer 21. For example, if a compressive pressure of ten psi is applied to layer 21, then layer 21 has a hydrostatic modulus in the range of 1000 to 2500 psi. The hydrostatic modulus K measures the resistance to change in volume without changes in shape under a hydrostatic pressure P. The hydrostatic modulus K equals $(Pv)/(\Delta v)$, where P is the hydrostatic pressure applied to the layer (assuming that the layer is initially under no pressure), and $(\Delta v)/(v)$ is the volumetric strain. The low hydrostatic modulus of layer 21 permits layer 21 to elastically deform. The high hydrostatic modulus of layer 22 helps to prevent scouring of soft material from work surface 23B, for instance, from between features 31 and 32. The higher hydrostatic modulus, K, of layer 22 promotes the bridging and planarizing by layer 22 of areas such as the area intermediate features 31 and 32. Layer 22 effectively bridges areas which are spaced a distance apart, indicated by arrows E in FIG. 3, that is up to about 500 to 600 microns. Urethane foams and other types of foam or elastic materials can be utilized in the practice of the invention as long as the desired hydrostatic modulus values are obtained.

Figure 4:
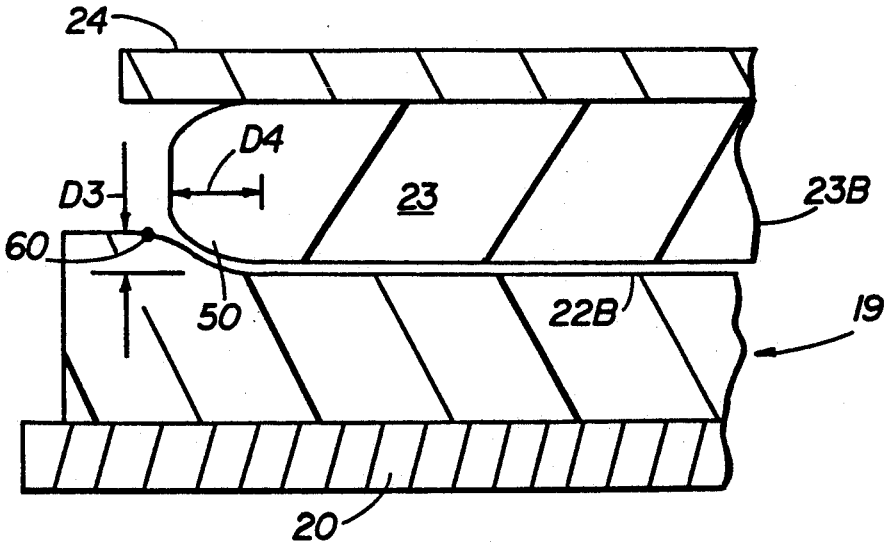
FIG. 4 is a side section view illustrating the compression of the composite polishing pad of the invention as it moves underneath a wafer of semiconductor material.
Figure 5:
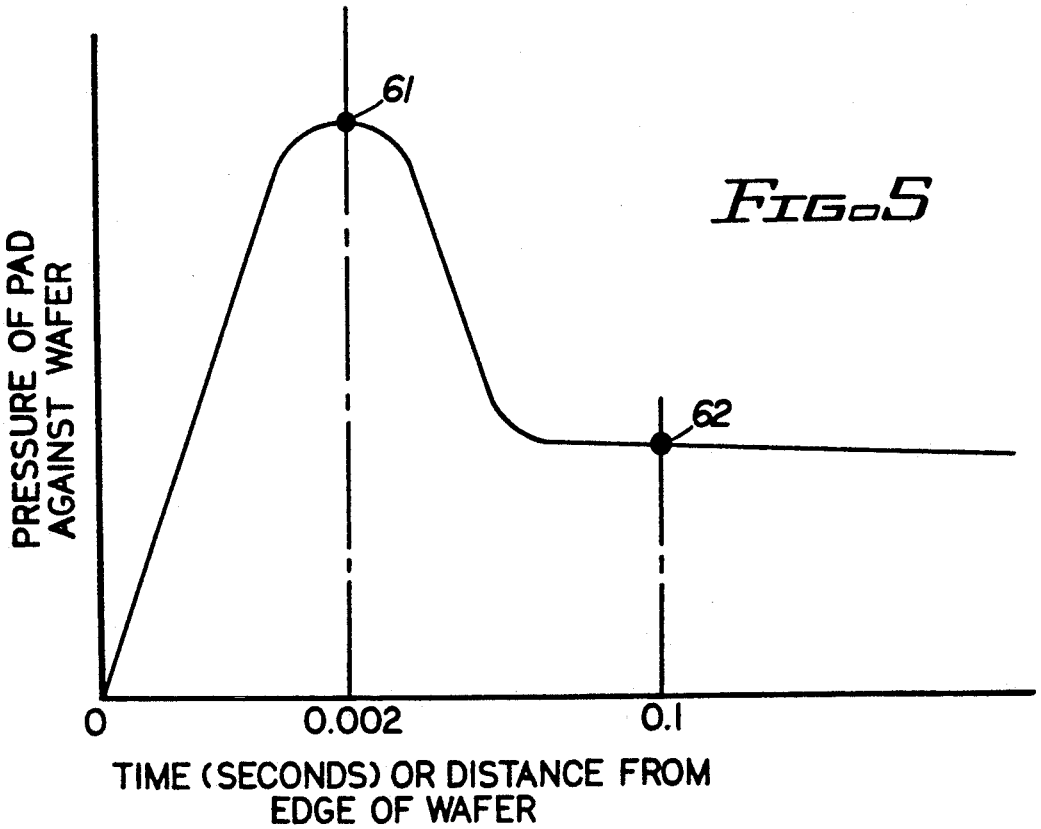
FIG. 5 is a graph representing the presence of a resilient polishing pad against a semiconductor material in relation to the time elapsed from when the pad first begins to move beneath the semiconductor material.

In arriving at the pad composition of the invention, it was important to recognize certain characteristics of the type of material removal being accomplished and of the materials utilized in the planarizing pad. First, the primary purpose of abrading the work surface of a coating 30 is planarization. This contrasts to the primary purpose of smoothness common to many polishing operations. Second, the planarizing apparatus of the invention is designed to simultaneously contact all or most of the points on a macroscopically or microscopically flat surface of a piece of material to abrade and planarize the surface. This type of material removal is distinguishable from operations which polish a limited area of a piece of material and, accordingly, constitute a point contact type of material removal. Third, a critical property of the composite planarizing pad of the invention is the hydrostatic modulus, K, of the resilient layers of material utilized in the pad. In FIG. 6, the portion of pad 22 following path Pl is compressed under wafer 23 for a longer period of time during each rotation of pad 22 than is portion of pad 22 which follows path P2. Regardless, however, of whether the pad 22 follows path P1 or P2, the time required to compress pads 21 and 22 (See also FIGS. 2 and 3) beneath wafer 23 is generally about the same. This is more specifically illustrated in FIG. 4, where the time required to compress the flexible pads comprising pad means 19 is indicated by the time required for pads 21 and 22 to move distance D4. After planarizing surface 22B contacts the rounded edge 50 of wafer 23 and moves the distance indicated by arrows D4 under wafer 23, the surface of pad means 10 is compressed a distance indicated by arrows D3. A typical time for surface 22B to be compressed distance D3 is in the range of 0.001 to 0.003 seconds, typically about 0.002 seconds. Such a time could, however, be as low as about 0.0003 seconds. The distance of D3 presently equals about 70 microns. A 70 micron compression in 0.002 seconds roughly translates to a compression rate of about one inch per second. With velocity of movement or compression, the stiffness of a piece of material increases and the force required to compress the material increases. The graph in FIG. 5 reflects this phenomenon. At a time equal to zero seconds in FIG. 5, point 60 is just at the outer edge of wafer 23 and is beginning to move underneath work surface 23B of wafer 23. At a time equal to 0.002 seconds in FIG. 5, point 60 on pad means 19 has moved a distance of D4 underneath wafer 23 and the resilient pads 21 and 22 have been compressed a distance indicated by arrows D3. At the time point 60 has moved distance D4 under wafer 23, the force of the pad means 19 acting against wafer 23 is, as we presently theorize it, at a maximum value indicated by point 61 in FIG. 5. As point 60 on pad means 19 continues to move beneath wafer 23, the force generated by the compressed pads 21 and 22 against wafer 23 gradually reduces until after point 60 of the pad means 19 has been under wafer 23 for 0.1 seconds the force generated by pad means 19 against wafer 23 at point 60 is indicated by point 62 in FIG. 5. This increase in the force generated by pad means 19 against wafer 23 with an increase in the velocity of compression of pads 21 and 22 mitigates against the use of elastic materials having a low hydrostatic modulus. On the other hand, a low hydrostatic modulus is desirable because it enhances the ability of pad 21 to quickly react and conform to undulations in the working surface 23B of wafer 23 while maintaining a more uniform pressure against the wafer 23.

Another problem associated with elastic pads fabricated from foam or other materials is hysteresis. Hysteresis is the tendency of a pad, after compressive pressure is released from the pad, not to elastically expand completely to its original shape.

In order to minimize the problem of hysteresis and to minimize the increase in force which occurs with an increase in the velocity of compression of an elastic pad material, we have discovered the composite pad shown in FIG. 7. The pad includes resilient foam material 22 having a hydrostatic modulus much lower than the hydrostatic modulus of the "pad" formed by the mass of gas filled bubbles positioned beneath pad 22. Air, nitrogen or any other desired gas can be included in each elastic bubble 70. Bubbles 70 can be interconnected or be separate and stacked on one another. One or more bubbles 70 can be utilized. Each bubble 70 completely encapsulates the gas or other fluid contained in the bubble. If desired, a first elastic bubble 70 can be interconnected with a second adjacent elastic bubble 70 such that the interconnection permits gas to flow between the bubbles and such that neither bubble completely encapsulates the gas in the bubble. Consequently, when the first bubble was compressed, gas would tend to be forced from the first bubble into the second bubble. The gas in bubble 70 minimizes the increase in force which results with an increase in the velocity of compression and also minimizes the effects of hysteresis. As would be appreciated by those of skill in the art, bubbles 70 can be removed from cylindrical chamber 71, chamber 71 filed with a gas, and pad 22 sealingly slidably engaged with the upper portion of chamber 71 in the fashion of a piston such that when pad 22 is pressed downwardly in the direction of arrow X, the air in chamber 71 is compressed and forces the pad surface 22B into substantial conformance with the globally undulating wafer surface.

Having described our invention in such terms as to enable those skilled in the art to understand and practice it, and having identified the presently preferred embodiments thereof, we claim:

1. Apparatus for planarizing a piece of material including a macroscopically flat subsurface, at least a pair of features each connected to said subsurface, each having an outer surface spaced away from said subsurface, each extending a substantially equal distance away from said subsurface, being spaced apart a distance of less than five hundred microns, a coating extending over and covering said features and said subsurface, the outer surface of said coating comprising a work surface which is macroscopically flat, said apparatus including (a) a planarizing pad including (i) a base, (ii) a first layer of resilient material connected to said base and having an outer surface spaced apart from said base and having a hydrostatic modulus which is less than 250 psi per psi of compressive pressure when a selected compressive pressure in the range of about four psi to twenty psi is applied to said first layer, (iii) a second layer of resilient material connected to at least a portion of said outer surface, having a planarizing surface spaced apart from said outer surface to contact and abrade said coating to expose said outer surfaces of said feature, and having a hydrostatic modulus greater than the hydrostatic modulus of said first layer when said selected compressive pressure is applied to said second layer, and (iv) a liquid slurry polishing media on said planarizing surface of said second layer;

(b) retaining means for holding said piece of material with said work surface disposed against and contacting said slurry media; and, (c) motive power means for moving at least one of said planarizing pad and said retaining means with respect to the other of said pad and said retaining means such that movement of said one of said pad and said retaining means causes said slurry and said planarizing surface to contact and abrade said work surface;

said planarizing surface microscopically planarizing at least said work surface to expose said outer surfaces of said features such that said work surface and said outer surfaces are generally microscopically flat and co-planar, said outer surfaces each terminate at and abut said work surface.

2. A polishing pad for use with a planarization apparatus, said pad comprising (a) a resilient base material having a hydrostatic modulus which is less than about 250 psi per psi of compressive pressure when a selected compressive pressure in the range of about four psi to twenty psi is applied to said base material; and (b) a second planarizing layer having a hydrostatic modulus greater than about 400 psi per psi of compressive pressure when said selected compressive pressure is applied to said second layer of material;

said pad being capable of being mounted on said planarizing apparatus to act in conjunction with a slurry to planarize the work surface of a workpiece.

3. The polishing pad of claim 2 wherein said second layer is comprised of a material having a planarizing surface which contacts said slurry.

4. Apparatus for planarizing a work surface of a piece of material, said work surface being macroscopically flat and microscopically flat such that said work surface deviates at all points from a median plane passing through said work surface by an amount less than about four microns, said apparatus including (a) a planarizing pad including (i) a base, (ii) a first layer of resilient material connected to said base and having an outer surface spaced apart from said base and having a hydrostatic modulus which is less than 250 psi per psi of compressive pressure when a selected compressive pressure in excess of about four psi is applied to said first layer of material, (iii) a second layer of resilient material connected to at least a portion of said outer surface, having a planarizing surface spaced apart from said outer surface, and having a hydrostatic modulus greater than the hydrostatic modulus of said first layer when said selected compressive pressure is applied to said second layer of material, and (iv) a slurry media on said planarizing surface of said second layer;

(b) retaining means for holding said piece of material with said work surface disposed against and contacting said slurry media;

(c) motive power means for moving at least one of said pad and said retaining means with respect to the other such that movement of said one of said pad and said retaining causes said slurry and said planarizing surface to contact and abrade said work surface.

5. The apparatus of claim 4, wherein the area of said work surface is less than sixteen square millimeters.

6. A polishing pad for use with a planarization apparatus comprising (a) a resilient base material being at least 0.015" thick and having at least 30% of its volume composed of voids such that the base material is volume compressible and will compress at least 5% under a load of 10 psi, (b) an intermediate layer at least 0.003" thick which is essentially volume incompressible, (c) a top planarizing layer at least 0.005" thick, having at least 25% of its volume composed of voids such that the planarizing layer is volume compressible and will compress at least 5% under a load of 100 psi., said polishing pad being capable of being mounted on a suitable apparatus for planarization and by acting in conjunction with a slurry to produce a planar surface on a workpiece.

7. The polishing pad of claim 6 wherein at least some of the voids in the top planarizing layer are formed by the incorporation of elastic bubbles containing gas.

8. The polishing pad of claim 6 wherein at least some of the voids in the resilient base layer are formed by the incorporation of elastic bubbles containing gas.

9. A polishing pad for use with a planarization apparatus comprising (a) a resilient base material being at least 0.015" thick and having at least 30% of its volume composed of voids such that the base material is volume compressible and will compress at least 5% under a load of 10 psi; and, (b) a top planarizing layer at least 0.005" thick, having at least 25% of its volume composed of voids such that the planarizing layer is volume compressible and will compress at least 5% under a load of 100 psi.;

said polishing pad being capable of being mounted on a suitable apparatus for planarization and by acting in conjunction with a slurry to produce a planar surface on a workpiece.

* * * * *